US008622448B1

(12) United States Patent
Butterfield, IV

(10) Patent No.: US 8,622,448 B1
(45) Date of Patent: Jan. 7, 2014

(54) CONNECTION FIXTURE FOR ATTACHING TO A STRUCTURE TO BE LIFTED AND A METHOD FOR USE THEREOF

(71) Applicant: Albert Eugene Butterfield, IV, Novato, CA (US)

(72) Inventor: Albert Eugene Butterfield, IV, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/763,091

(22) Filed: Feb. 8, 2013

(51) Int. Cl.
*B66C 1/00* (2006.01)

(52) U.S. Cl.
USPC ..... 294/67.1; 294/901

(58) Field of Classification Search
USPC ..... 294/67.1, 82.1, 215, 82.11, 89, 158, 294/901
See application file for complete search history.

(56) References Cited

U.S. PATENT DOCUMENTS

| | | | | | |
|---|---|---|---|---|---|
| 2,137,737 | A * | 11/1938 | Wenzel | ..... | 266/274 |
| 3,197,101 | A * | 7/1965 | Brown | ..... | 294/158 |
| 3,237,825 | A * | 3/1966 | Marbut | ..... | 294/158 |
| 3,253,707 | A * | 5/1966 | Gooding | ..... | 206/597 |
| 3,342,521 | A | 9/1967 | Renfroe | | |
| 4,405,168 | A | 9/1983 | Fritzsche et al. | | |
| 4,664,255 | A * | 5/1987 | Griffith | ..... | 206/162 |
| 4,802,813 | A * | 2/1989 | Perry | ..... | 414/607 |
| 5,893,595 | A | 4/1999 | Corbett | | |
| 6,068,310 | A * | 5/2000 | Fuller et al. | ..... | 294/215 |
| 8,356,850 | B1 * | 1/2013 | Starkweather et al. | ..... | 294/158 |
| 8,491,027 | B2 * | 7/2013 | Izzo | ..... | 294/158 |
| 2011/0175384 | A1 * | 7/2011 | Segura | ..... | 294/82.1 |

* cited by examiner

*Primary Examiner* — Saul Rodriguez
*Assistant Examiner* — Gabriela Puig
(74) *Attorney, Agent, or Firm* — Karen R. DiDomenicis

(57) ABSTRACT

Disclosed is a connection fixture capable of attaching without the use of bolts to an upper portion of a structure to be lifted to facilitate the lifting thereof. In one embodiment, the connection fixture includes an outer angle iron and an inner angle iron attached in a vertically slideable relationship with respect to one another between an open position and a closed position. In the open position, the connection fixture can be positioned to engage a plurality of holes in an upper horizontal lip of the structure to be lifted. In the closed position, the upper lip is securely captured between the outer angle iron and the inner angle iron. A shackle can be secured through holes in the connection fixture. In another embodiment, the connection fixture includes first and second planar elements between which can be captured an upper portion of the structure to be lifted.

13 Claims, 4 Drawing Sheets

CONNECTION FIXTURE FOR ATTACHING TO A STRUCTURE TO BE LIFTED AND A METHOD FOR USE THEREOF

FIELD

The present disclosure relates to connection fixtures of the type for attaching to a structure to be lifted to facilitate the lifting thereof. The present disclosure further relates to a method of use of such connection fixtures.

BACKGROUND

There are presently a number of means available for lifting heavy structural elements. For example, large structural steel panels of the type used in the construction of large industrial facilities are commonly lifted by bolting a connection fixture to the panel to which lifting cables can be attached. Such lifting cables are operated from above by lifting devices such as cranes, hoists, winches, and the like. Frequently a spreader bar, also referred to as a spreader beam or a lifting beam, is suspended from the connection device and the lifting cables attach the load to the spreader bar.

Although the use of bolt-on connection fixtures with such devices is quite simple and has been in use for many years, it has been found that this still leaves much to be desired in terms of precise, safe and ergonomic operation. Having to manually install bolts to attach the connection fixture to each panel is extremely time-consuming and fraught with potential for human error as well as repetitive stress injury. From the perspective of the construction workers, it would be desirable to have a way to attach the connection fixture which would avoid the use of bolts. From an economic perspective, it would further be desirable to have a way to facilitate the attachment of the connection fixture without the time-consuming procedure of installing individual bolts.

SUMMARY

In one aspect, a connection fixture is provided capable of engaging holes in an upper horizontal lip of a structure to be lifted. The connection fixture includes an outer angle iron and an inner angle iron which attach to one another in a mating relationship wherein the outer angle iron and the inner angle iron are slideable with respect to one another between an open position and a closed position. Each of the outer angle iron and the inner angle iron are formed of a length of structural angle having a vertical portion having a shackle receiving hole therein and a horizontal portion. The horizontal portion of the outer angle iron has a plurality of pins distributed along the length thereof protruding upwardly. A plurality of fasteners is attachable to the vertical portion of the outer angle iron such that the bushings when attached protrude inwardly from the vertical portion of the outer angle iron. The inner angle iron has a plurality of holes in the horizontal portion of the inner angle iron distributed along the length thereof which align with the plurality of pins protruding from the horizontal portion of the outer angle iron. The vertical portion of the inner angle iron has a plurality of vertical slots distributed along the length thereof which align with the plurality of fasteners attachable to the vertical portion of the outer angle iron. The outer angle iron and the inner angle iron each has a shackle receiving hole through which a shackle can be installed when the connection fixture is in the closed position.

In another aspect, a method is provided for securing the connection fixture to an upper horizontal lip of a structure to be lifted wherein the upper horizontal lip has a plurality of holes therein. The method includes sliding the inner angle iron upward with respect to the outer angle iron thereby providing space between the horizontal portions of the inner angle iron and the outer angle iron; upwardly inserting the plurality of pins protruding upwardly from the horizontal portion of the outer angle iron into a plurality of holes in the upper horizontal lip of the structure to be lifted; and sliding the inner angle iron downward with respect to the outer angle iron into a closed position. In the closed position, the plurality of pins passes through the upper horizontal lip of the structure to be lifted and the horizontal portion of the inner angle iron; the upper horizontal lip of the structure to be lifted is held in intimate contact between the horizontal portions of the inner angle iron and the outer angle iron; and the shackle receiving holes of the inner angle iron and the outer angle iron are aligned. At this point, a shackle can be attached to the connection fixture through the shackle receiving holes.

In yet another aspect, a connection fixture is provided capable of engaging holes in a structure to be lifted without an upper horizontal lip. The connection fixture includes a first planar element having a shackle receiving hole therein and a plurality of pins distributed along the length thereof; and a second planar element having a shackle receiving hole therein and having a plurality of pin receiving holes distributed along the length thereof. The first planar element and the second planar element are capable of mating with one another in such a way that the pins of the first planar element are positionable to align with the plurality of holes in the second planar element and the shackle receiving holes of the first planar element are positionable to align with the shackle receiving holes of the second planar element.

In yet another aspect, a connection fixture is provided capable of engaging a structure. The connection fixture includes a first structural angle iron having first and second portions, and a second structural angle iron having first and second portions. The first portion of the first structural angle iron has a shackle-receiving hole. The second portion of the first structural angle iron extends at a first angle from the first portion and has a plurality of pins distributed along the length of the second portion and protruding in a direction generally parallel to the first portion. The first portion of the second structural angle iron has a shackle-receiving hole, and the second portion of the second structural angle iron extends from the first portion at the first angle and has a plurality of holes distributed along the length thereof. The first portions of the first and second structural angle irons are slideably connected to one another such that the second portion of the first structural angle iron is configured to be slideably translated toward the second portion of the second structural angle iron to insert the plurality of pins of the first structural angle iron into the plurality of holes of the second structural angle iron and align the shackle-receiving holes of the first and second structural angle irons with the lip of the structure disposed between the second portions of the first and second structural angle irons.

DESCRIPTION OF THE DRAWINGS

These and other objects, features and advantages of the present invention will become better understood with reference to the following description, appended claims and accompanying drawings where:

DETAILED DESCRIPTION

Figure 1A:
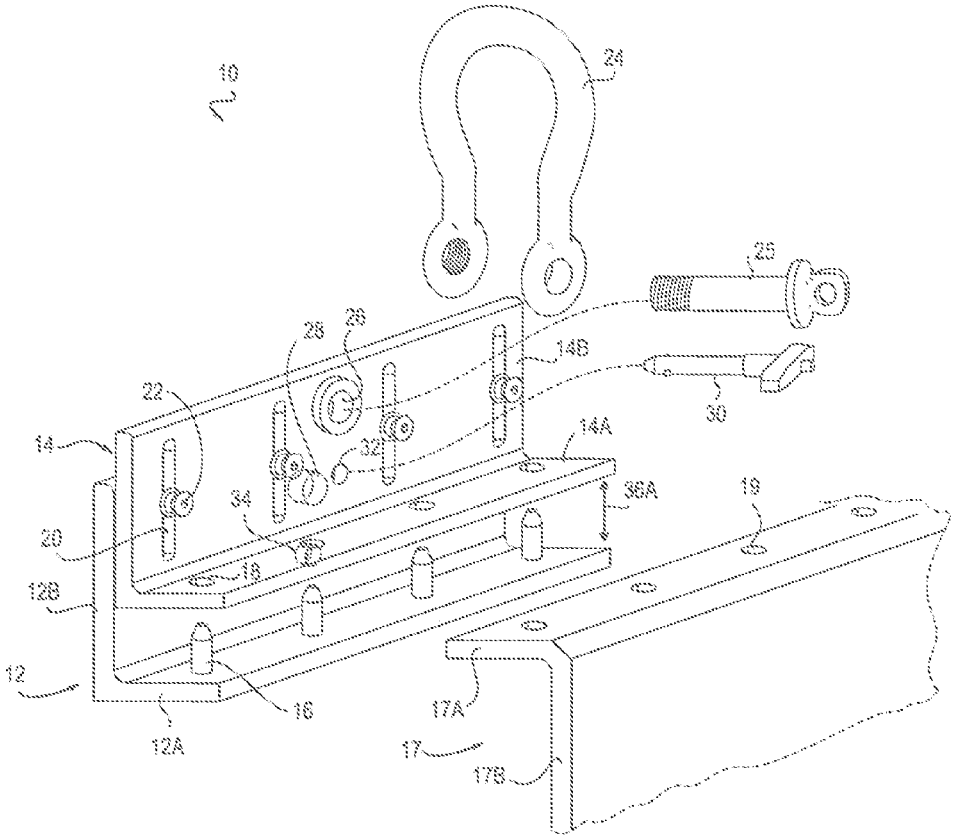
FIG. 1A and FIG. 1B are perspective views of a connection fixture according to one exemplary embodiment in an open position and a closed position, respectively.
Figure 1B:
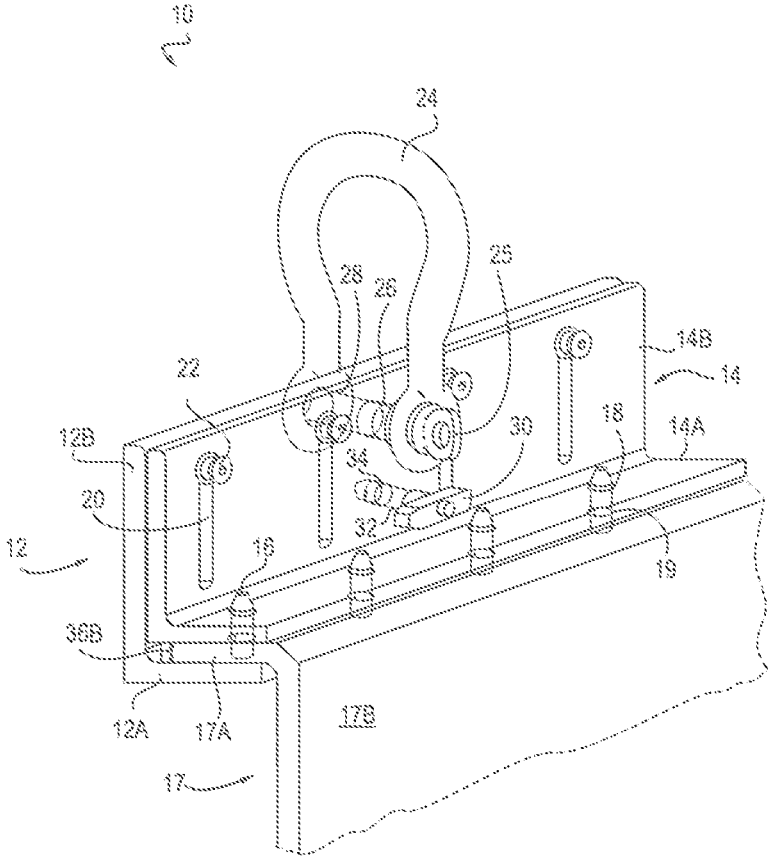

A connection fixture is provided which can be securely connected to a lip of a structure to facilitate lifting of the structure. One embodiment of a connection fixture 10 for engaging holes in an upper horizontal lip of a structure 17 to be lifted is illustrated in FIGS. 1A and 1B. FIG. 1A illustrates the device in the open position, and FIG. 1B illustrates the device in the closed position, as will be described further herein. The connection fixture 10 includes a length of structural angle referred to as an outer angle iron 12 and a length of structural angle referred to as an inner angle iron 14 between which can be securely captured an upper horizontal lip of a structure to be lifted, as will be described further herein.

The outer angle iron 12 and the inner angle iron 14 are formed of a metallic material selected from the group consisting of iron, steel, aluminum, and alloys thereof. The metallic material is extruded and finished by milling to the exact desired dimensions. Each of the outer angle iron 12 and the inner angle iron 14 has a cross-section which is generally L-shaped, by which is meant that the structural angle has a vertical portion and a horizontal portion which intersect to form a lower right angle. The outer angle iron 12 has a horizontal portion 12A and a vertical portion 12B. Likewise, the inner angle iron 14 has a horizontal portion 14A and a vertical portion 14B.

In one embodiment, the outer angle iron 12 and the inner angle iron 14 have similar lengths. In one embodiment, the length of the outer angle iron 12 and the length of the inner angle iron 14 are each from 16 in (40.6 cm) to 24 in (61.0 cm). In one embodiment, the vertical portion 12B of the outer angle iron 12 and the vertical portion 14B of the inner angle iron 14 are each from 3 to 6 inches (7.6 to 15.2 cm) in height. In one embodiment, the horizontal portion 12A of the outer angle iron 12 and the horizontal portion 14A of the inner angle iron 14 are each from 5 to 6 inches (12.7 to 15.2 cm) in depth. In one embodiment, the vertical and horizontal portions of the outer angle iron 12 and the inner angle iron 14 are each from 0.375 to 0.5 inches (0.95 to 1.3 cm) in thickness. These dimensions are provided for example only, and are nonlimiting.

The outer angle iron 12 and the inner angle iron 14 can be mated such that the inner angle iron 14 is positioned within the right angle of the outer angle iron 12, and the vertical and horizontal portions of the inner angle iron are positioned adjacent the vertical and horizontal portions of the outer angle iron. This is referred to herein as a "mating relationship."

The horizontal portion 12A of the outer angle iron 12 has a plurality of pins 16 distributed along the length thereof protruding upwardly from the horizontal portion. Said pins 16 can be integrally formed as part of the outer angle iron 12. Alternatively, the pins 16 can be threaded fasteners such that they can be inserted into corresponding threaded holes in the horizontal portion 12A. The horizontal portion 14A of the inner angle iron 14 has a plurality of holes 18 distributed along the length thereof in positions corresponding to the pins 16 protruding from the horizontal portion 12A of the outer angle iron 12. The dimensions of the pins 16 and the holes 18 are such that the pins 16 fit within the holes 18.

The vertical portion 14B of the inner angle iron 14 has a plurality of vertical slots 20 distributed along the length thereof. The vertical portion 12B of the outer angle iron 12 has a plurality of openings located at lengthwise positions corresponding to the plurality of vertical slots 20. When the inner angle iron 14 is positioned in a mating relationship with the outer angle iron 12, the openings are accessible through the vertical slots 20. Fasteners such as threaded bushings 22 can be installed in the openings which may be threaded openings through the vertical slots 20, thus securing the outer angle iron 12 and the inner angle iron 14 to one another. When attached, the bushings 22 protrude inwardly from the vertical portion 12B of the outer angle iron 12. The tension applied by the bushings 22 when the bushings are properly installed is such that the inner angle iron 14 is retained in a vertically slideable relationship with respect to the outer angle iron 12, i.e., the inner angle iron 14 is able to slide up and down vertically with respect to the outer angle iron 12, with little or no relative horizontal motion. In other words, the vertical portions of the inner and outer angle irons are slideably connected to one another such that the horizontal portion of the outer angle iron is configured to be translated toward the horizontal portion of the inner angle iron to insert the plurality of pins of the outer angle iron into the plurality of holes of the inner angle iron and align the shackle-receiving holes of the inner and outer angle irons with the lip of the structure disposed between the horizontal portions of the inner and outer angle irons. When the inner angle iron 14 is positioned at the highest position relative to the outer angle iron 12, the horizontal portion 14A is well above the horizontal portion 12A such that a gap 36A is provided between the pins 16 and the horizontal portion 14A. Gap 36A provides sufficient clearance such that the upper horizontal lip of the structure to be lifted fits therein. This is referred to herein as the "open position" of the connection fixture. When the inner angle iron 14 is positioned at the lowest position relative to the outer angle iron 12, the pins 16 fit within the holes 18 of the horizontal portion 14A. A smaller gap 36B is provided between the horizontal portion 12A and the horizontal portion 14A. Gap 36B is sufficient merely to fit the upper horizontal lip of the structure to be lifted therein during use of the connection fixture. This is referred to herein as the "closed position" of the connection fixture.

In one embodiment, the plurality of pins 16 is symmetrically distributed along the length of the outer angle iron 12. In one embodiment, the plurality of threaded bushings 22 is symmetrically distributed along the length of the outer angle iron 12. By "symmetrically distributed along the length" is meant that when the length is bisected into two equal halves, there is an equal number in each one.

Each of the vertical portion 14B of the inner angle iron 14 and the vertical portion 12B of the outer angle iron 12 includes a hole therein by which a shackle can be attached to the connection fixture when the connection fixture is in the closed position. Shackle receiving hole 26 in the vertical portion 14B of the inner angle iron 14 is positioned to align with the shackle receiving hole 28 in the vertical portion 12B of the outer angle iron 12. In one embodiment, the diameters of the shackle receiving holes can be from 1.3 to 2.8 cm. In one embodiment, the shackle receiving holes 28 and 26 are centered with respect to the lengths and of the outer angle iron 12 and the inner angle iron 14, respectively.

In one embodiment, the connection fixture 10 further includes a shackle attachable to the connection fixture 10 through the shackle receiving holes 26 and 28 when the connection fixture is in the closed position. The shackle can be a screw pin anchor type shackle having a hook portion 24 and a screw pin portion 25. In one embodiment, the shackle has a working load limit of from 9 tons (8.2 metric tons) to 12 tons (10.9 metric tons).

In one embodiment, each of the vertical portion 14B of the inner angle iron 14 and the vertical portion 12B of the outer angle iron 12 includes a hole therein by which an optional quick release locking pin 30 can be attached to the connection fixture 10 when the connection fixture is in the closed position. Quick release locking pin receiving hole 32 in the vertical portion 14B of the inner angle iron 14 is positioned to align with the quick release locking pin receiving hole 34 in the vertical portion 12B of the outer angle iron 12. The optional quick release locking pin 30 can be inserted through the quick release locking pin receiving holes 32 and 34 when the connection fixture 10 is in the closed position to hold the inner angle iron 14 in place with respect to the outer angle iron 12 temporarily while the shackle 24 is attached.

In one embodiment, the connection fixture 10 is used to lift a structure 17 having an upper horizontal lip 17A having a plurality of pin receiving holes 19 therein. With the connection fixture 10 in the open position, the plurality of pins 16 protruding from the horizontal portion 12A of the outer angle iron 12 are upwardly inserted into the pin receiving holes 19 in the upper horizontal lip of the structure to be lifted from the underside of the lip 17A. The inner angle iron 14 can then be slid downward with respect to the outer angle iron 12 into the closed position. In so doing, the plurality of pins 16 passes through the upper horizontal lip 17A of the structure to be lifted and the holes 18 in the horizontal portion 14A of the inner angle iron 14, and the upper horizontal lip 17A of the structure to be lifted is held in intimate contact between the horizontal portions of the inner angle iron and the outer angle iron (14A and 12A, respectively). In this position, the shackle receiving holes 26 and 28 of the inner angle iron and the outer angle iron, respectively, are aligned. At this point, in one embodiment, the quick release locking pin 30 can optionally be inserted through the quick release locking pin receiving holes 32 and 34 to temporarily hold the connection fixture 10 in the closed position. The shackle 24 can then be attached through the shackle receiving holes 26 and 28 and the screw pin portion 25 can be tightly secured so that the connection fixture 10 is ready for use, as illustrated in FIG. 1B.

It is an advantage of the present connection fixture that it can be installed on the upper horizontal lip 17A of the structure to be lifted 17 without the use of bolts and by extension, without the use of corresponding nuts. No bolts need be fastened through the upper horizontal lip of the structure to be lifted in securing the connection fixture to the upper horizontal lip. The steps involved in installing the connection fixture of the present disclosure are less time-consuming and more ergonomically friendly than conventional methods using known connection devices.

It is another advantage of the present connection fixture that in the event that the connection fixture is used to lift an excessive load exceeding the yield strength of the outer angle iron 12, physical distortion of the outer angle iron 12 will result, and the connection fixture will no longer be operable in that the device can no longer be moved into the closed position.

Figure 2A:
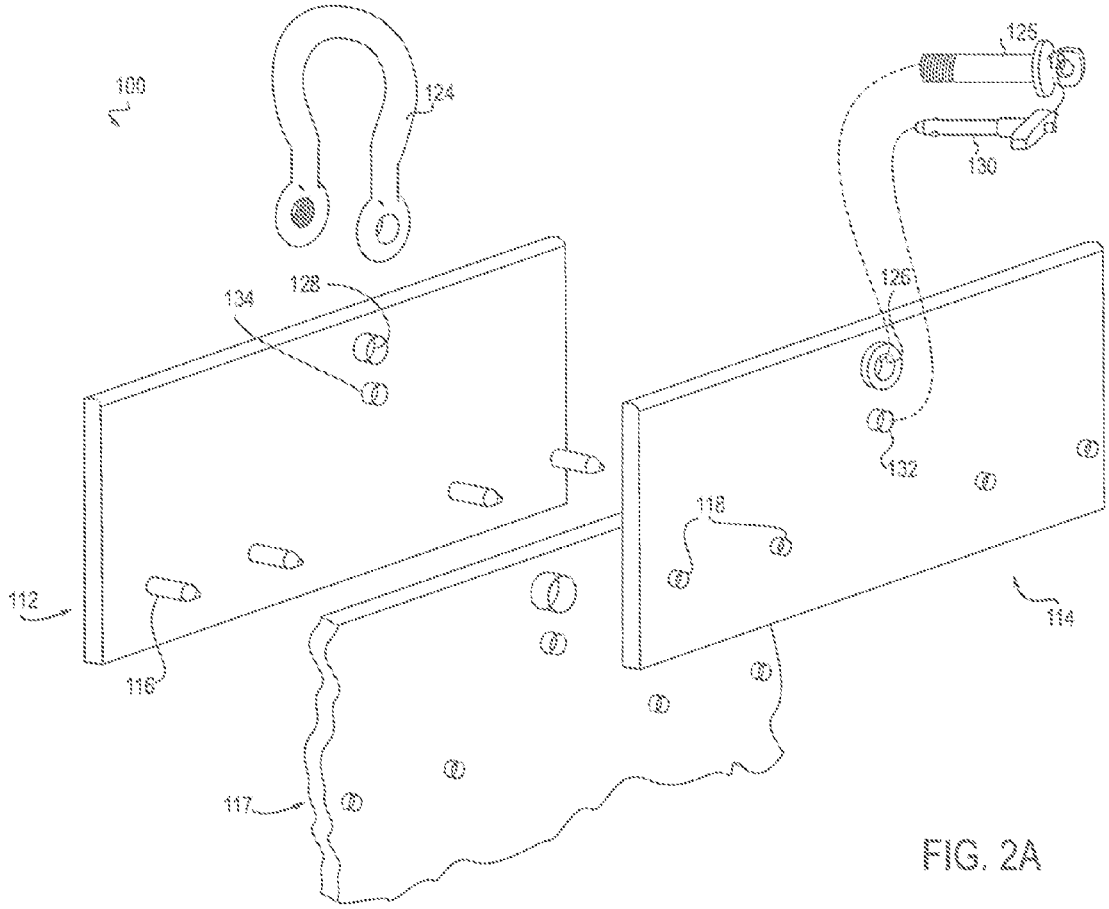
FIG. 2A and FIG. 2B are perspective views of a connection fixture according to another exemplary embodiment in an open position and a closed position, respectively.
Figure 2B:
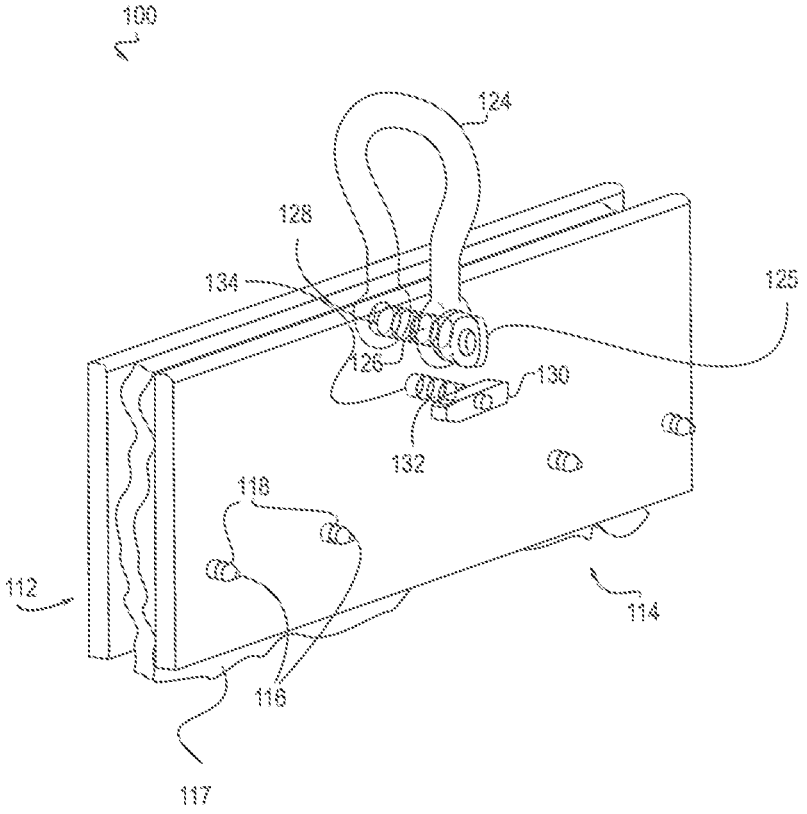

FIGS. 2A and 2B illustrated another embodiment of a connection fixture 100 for engaging holes in a structure 117 to be lifted without an upper horizontal lip. FIG. 2A illustrates the device in the open position, and FIG. 2B illustrates the device in the closed position. The connection fixture 100 includes two similarly sized structural planar elements referred to as a first planar element 112 and a second planar element 114 between which can be securely captured a planar portion of a structure to be lifted, as will be described further herein. The first planar element 112 and the second planar element 114 are formed of a metallic material selected from the group consisting of iron, steel, aluminum, and alloys thereof.

In one embodiment, the length of the first planar element 112 and the second planar element 114 are each from 16 in (40.6 cm) to 24 in (61.0 cm). In one embodiment, the height of the first planar element 112 and the second planar element 114 are each from 3 to 10 inches (7.6 to 25.4 cm). In one embodiment, the first planar element 112 and the second planar element 114 are each from 0.375 to 0.5 inches (0.95 to 1.3 cm) in thickness. These dimensions are provided for example only, and are nonlimiting.

The first planar element 112 has a plurality of pins 116 distributed along the length thereof protruding outwardly from the surface thereof. In one embodiment, the plurality of pins are symmetrically distributed along the length of the first planar element 112. Said pins 116 can be integrally formed as part of the first planar element 112. Alternatively, the pins can be threaded fasteners such that they can be inserted into corresponding threaded holes in the first planar element 112. The second planar element 114 has a plurality of holes 118 distributed along the length thereof in positions corresponding to the pins 116 protruding from the first planar element 112; and the dimensions of the pins 116 and the holes 118 are such that the pins fit within the holes.

The first planar element 112 and the second planar element 114 include shackle receiving holes 128, 126, respectively, by which a shackle can be attached to the connection fixture 100 when the connection fixture is in the closed position and the shackle receiving holes are positioned to align with one another. In one embodiment, the diameters of the shackle receiving holes can be from 1.3 to 2.8 cm. In one embodiment, the shackle receiving holes 128 and 126 are centered with respect to the lengths and of the first planar element 112 and the second planar element 114, respectively.

In one embodiment, the connection fixture 100 further includes a shackle as previously described herein attachable to the connection fixture 100 through the shackle receiving holes 128 and 126 when the connection fixture is in the closed position.

In one embodiment, each of the first planar element 112 and the second planar element 114 includes a hole therein by which an optional quick release locking pin 130 as previously described herein can be attached to the connection fixture 100 when the connection fixture is in the closed position. Quick release locking pin receiving hole 134 in the first planar element 112 is positioned to align with the quick release locking pin receiving hole 132 in the second planar element 114. The optional quick release locking pin 130 can be inserted through the quick release locking pin receiving holes 132 and 134 when the connection fixture 100 is in the closed position to hold the first planar element 112 and the second planar element 114 temporarily while the shackle 125 is attached.

In one embodiment, the connection fixture is used to lift a planar portion of a structure to be lifted having a plurality of pin receiving holes therein. With the connection fixture in the open position, the plurality of pins protruding from the first planar element 112 are inserted into the pin receiving holes in the structure to be lifted and the second planar element 114. In this position, the shackle receiving holes of the first planar element and the second planar element are aligned. At this point, in one embodiment, the quick release locking pin 130 can optionally be inserted through the quick release locking pin receiving holes to temporarily hold the connection fixture in the closed position. The shackle 125 can then be attached through the shackle receiving holes and the screw pin portion of the shackle can be tightly secured so that the connection fixture is ready for use, as illustrated in FIG. 2B.

It is an advantage of the present connection fixture that it can be installed on the structure to be lifted without the use of bolts and by extension, without the use of corresponding nuts. The steps involved in installing the connection fixture are less time-consuming and more ergonomically friendly than conventional methods using known connection devices.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. A connection fixture for engaging a lip of a structure, comprising:

a. an outer angle iron comprising a length of structural angle having a vertical portion defining a shackle receiving hole therein and a horizontal portion wherein the vertical portion and the horizontal portion intersect to form a lower right angle, further comprising a plurality of pins distributed along the length thereof protruding upwardly from the horizontal portion thereof;

b. a plurality of fasteners distributed along the length of the outer angle iron and attachable to the vertical portion of the outer angle iron such that the fasteners when attached protrude inwardly from the vertical portion of the outer angle iron; and c. an inner angle iron comprising a length of structural angle having a vertical portion defining a shackle receiving hole therein and a horizontal portion wherein the vertical portion and the horizontal portion intersect to form a lower right angle, further defining a plurality of holes in the horizontal portion of the inner angle iron distributed along the length thereof and a plurality of vertical slots in the vertical portion of the inner angle iron distributed along the length thereof;

wherein the outer angle iron and the inner angle iron are capable of mating with one another in such a way that the vertical and horizontal portions of the inner angle iron are positioned adjacent the vertical and horizontal portions of the outer angle iron, and the fasteners are attached to the vertical portion of the outer angle iron through the slots in the vertical portion of the inner angle iron thereby retaining the inner angle iron in a vertically slideable relationship with respect to the outer angle iron;

wherein the pins protruding from the horizontal portion of the outer angle iron are positionable to align with the plurality of holes in the horizontal portion of the inner angle iron and holes in the lip of the structure in such a way that the pins can pass through the holes in the lip of the structure and the holes in the horizontal portion of the inner angle iron; and wherein the shackle receiving hole of the outer angle iron is positionable to align with the shackle receiving hole of the inner angle iron.

2. The connection fixture of claim 1, wherein the structural angle comprises a metallic material selected from the group consisting of iron, steel, aluminum, and alloys thereof and the structural angle is formed by extrusion.

3. The connection fixture of claim 1, wherein the length of the outer angle iron and the length of the inner angle iron are each from 40.6 to 61.0 cm.

4. The connection fixture of claim 3, wherein the shackle receiving holes are centered with respect to the lengths and of the outer angle iron and the inner angle iron.

5. The connection fixture of claim 1, wherein:

a. the diameter of the shackle receiving holes is from 1.3 to 2.8 cm;

b. the height dimension of the vertical portion of the structural angle of the outer angle iron and the vertical portion of the structural angle of the inner angle iron are each from 7.6 to 15.2 cm;

c. the depth dimension of the horizontal portion of the structural angle of the outer angle iron and the horizontal portion of the structural angle of the inner angle iron are each from 12.7 to 15.2 cm; and d. the thickness dimension of the vertical and horizontal portions of the structural angles of the outer angle iron and the inner angle iron are each from 0.95 to 1.3 cm.

6. The connection fixture of claim 1, further comprising:

a. a shackle attachable to the connection fixture through the shackle receiving holes of the outer angle iron and the inner angle iron when aligned with one another.

7. The connection fixture of claim 6, wherein the shackle is a screw pin anchor type shackle.

8. The connection fixture of claim 6, wherein the shackle has a working load limit of from 8.2 to 10.9 metric tons.

9. The connection fixture of claim 6, further comprising:

a. a pair of quick release locking pin receiving holes located in each of the vertical portions of the inner angle iron and the outer angle iron wherein the quick release locking pin receiving holes are positionable to align with one another; and b. a quick release locking pin capable of being inserted through the quick release locking pin receiving holes to hold the inner angle iron in place with respect to the outer angle iron temporarily while the shackle is attached.

10. A method for securing the connection fixture of claim 6 to the upper horizontal lip of a structure to be lifted wherein the upper horizontal lip has a plurality of holes therein, comprising:

a. sliding the inner angle iron upward with respect to the outer angle iron thereby providing space between the horizontal portions of the inner angle iron and the outer angle iron;

b. upwardly inserting the plurality of pins protruding upwardly from the horizontal portion of the outer angle iron into a plurality of holes in the upper horizontal lip of the structure to be lifted;

c. sliding the inner angle iron downward with respect to the outer angle iron such that:

i. the plurality of pins passes through the upper horizontal lip of the structure to be lifted and the horizontal portion of the inner angle iron;

ii. the upper horizontal lip of the structure to be lifted is held in intimate contact between the horizontal portions of the inner angle iron and the outer angle iron; and iii. the shackle receiving holes of the inner angle iron and the outer angle iron are aligned; and d. attaching the shackle through the shackle receiving holes.

11. The method of claim 10, wherein no bolts are fastened through the upper horizontal lip of the structure to be lifted in securing the connection fixture to the upper horizontal lip.

12. The connection fixture of claim 1, wherein the plurality of pins protruding upwardly from the horizontal portion of the outer angle iron comprise threaded fasteners inserted through holes in the horizontal portion of the outer angle iron.

13. The connection fixture of claim 1, wherein the plurality of pins is symmetrically distributed along the length of the outer angle iron, and the plurality of fasteners is symmetrically distributed along the length of the outer angle iron.

* * * * *